US005423335A

United States Patent [19]

Evans

[11] Patent Number: 5,423,335

[45] Date of Patent: Jun. 13, 1995

[54] SMOKER'S UTILITY APPARATUS

[76] Inventor: Daniel Evans, P.O. Box 216, Strong, Ark. 71765

[21] Appl. No.: 191,397

[22] Filed: Feb. 2, 1994

[51] Int. Cl.[6] ..... A24F 19/10

[52] U.S. Cl. ..... 131/329; 131/232

[58] Field of Search ..... 131/329, 185, 231, 232, 131/234, 238, 240.1, 243, 242; 206/126, 135, 136, 223, 572, 575, 236, 242, 244, 496

[56] References Cited

U.S. PATENT DOCUMENTS

| | | | |
|---|---|---|---|
| 833,897 | 10/1906 | Reynolds | 131/234 X |
| 1,968,191 | 7/1934 | Danner | 131/234 |
| 2,096,405 | 10/1937 | Phillips | 131/232 |
| 2,387,790 | 10/1945 | Williamson | 206/236 |
| 3,503,520 | 3/1970 | Meyer | 131/232 X |
| 3,566,882 | 3/1971 | Schroeder . | |
| 4,267,926 | 5/1981 | Toimil . | |
| 4,300,675 | 11/1981 | Wagner . | |
| 4,588,076 | 5/1986 | Caputo et al. . | |
| 5,074,412 | 12/1991 | White . | |

FOREIGN PATENT DOCUMENTS

| | | | |
|---|---|---|---|
| 627736 | 10/1927 | France | 131/231 |
| 348019 | 2/1922 | Germany | 131/240.1 |
| 435745 | 9/1935 | Germany | 131/232 |
| 2740977 | 3/1979 | Germany | 131/329 |

*Primary Examiner*—Jennifer Bahr

[57] ABSTRACT

A new and improved smoker's utility apparatus includes a base assembly which has a longitudinal axis and a transverse axis. A plurality of wells are contained within the base assembly. The wells include first wells adapted to receive containers. The wells include second wells adapted to receive pipe tools, and the wells include a third well extending substantially an entire longitudinal dimension of the base assembly adapted to receive a plurality of loose items. A plurality of containers are adapted to be received into the first wells in the base assembly. A plurality of pipe tools are adapted to be received into the second wells in the base assembly. A rough-surfaced striking surface is supported by the base assembly for igniting nonsafety matches struck on the rough-surfaced striking surface. One of the containers received in the wells of the base assembly is an ash tray. The ash tray includes receiving areas adapted to receive a cigar or a cigarette. The ash tray includes a clamp assembly adapted to receive and support a pipe. The pipe clamp assembly is supported by a support column which is supported by a floor portion of the ash tray. The containers include air-tight containers. The air-tight containers include body portions and lid portions.

2 Claims, 2 Drawing Sheets

SMOKER'S UTILITY APPARATUS

BACKGROUND OF THE INVENTION

1. Field of the Invention

The present invention relates generally to utility boxes and, more particularly, to utility boxes adapted for satisfying the needs of a tobacco smoker, especially a pipe smoker.

2. Description of the Prior Art

Forms of tobacco that are smoked are numerous and include cigarettes, cigars, and pipes. For convenience, a number of forms of tobacco can be stored in one location to give smoker a choice as to which form of tobacco to smoke. In this respect, it would be desirable if a device were provided which conveniently stored a number of forms of tobacco.

To preserve their freshness, some forms of tobacco should be stored in airtight containers. In this respect, it would be desirable if a tobacco storage device were provided which included air-tight containers.

To smoke tobacco, the tobacco must be lit by a flame. For convenience, it would be desirable if flame producing devices, such a matches, were kept near the tobacco so that the tobacco could be readily lit.

Smoked tobacco products inevitably form ashes. In this respect, it would be desirable if a tobacco storage device were provided with an ash receptacle for receiving the tobacco ashes.

When a cigar or cigarette is smoked, oftentimes the smoker wishes to set down the burning article for a brief period of time. For this purpose, ash trays often include support structures for supporting a burning cigar or cigarette.

A pipe is a smoker's article that has certain unique characteristics which differentiate it from a cigar or cigarette. Cigars and cigarettes are substantially cylindrical objects, and, as a result, their weight is distributed symmetrically about their center of gravity which lies on their longitudinal axes. With their center of gravity located along their longitudinal axes, there is little or no tendency of a cigar or cigarette to tip over. On the other hand, a pipe is an L-shaped article that includes a bowl and a stem. The center of gravity of the pipe is generally located above the longitudinal axis of the pipe stem. As a result, there is a strong tendency for the pipe to tip over when the pipe is set down on the pipe stem. When a pipe is lit and has burning tobacco in the bowl, substantial danger and inconvenience can result when the pipe tips over. In this respect, it would be desirable if a tobacco storage device were provided which included a pipe rest that is adapted to prevent a pipe from tipping over when the pipe is placed in the pipe rest.

Pipe smoking involves more than simply placing tobacco in the pipe bowl and lighting up. An important aspect of pipe smoking is the cleaning and maintenance of the pipe. For pipe cleaning and maintenance, certain pipe tools are especially useful. In this respect, it would be desirable if a tobacco storage device were provided with pipe tools to facilitate cleaning and maintenance of the pipe.

For smoking tobacco, an ignition source must be provided for lighting the tobacco. For this purpose, matches are often used. There are two kinds of matches: safety matches; and nonsafety matches. To ignite a nonsafety match, the match must be struck along a rough surface. In this respect, it would be desirable if a tobacco storage device were provided with a rough surface that is suitable for igniting nonsafety matches.

As mentioned above, it would be desirable for a smoker's utility device to include air-tight containers. However, when a plurality of air-tight containers are employed, there may be a tendency for the containers to move about and bump into one another. In this respect, it would be desirable if a tobacco storage device were provided which included a plurality of air-tight containers that are prevented from moving around and bumping into each other.

Throughout the years, a number of innovations have been developed relating to smoker's utility devices, and the following U.S. Pat. Nos. are representative of some of those innovations: 3,566,882; 4,267,926; 4,300,675; 4,588,076; and 5,074,412. However, none of the devices disclosed in the cited patents provides the beneficial features discussed above for a smoker's utility device.

Thus, while the foregoing body of prior art indicates it to be well known to use storage containers for smoker's articles, the prior art described above does not teach or suggest a smoker's utility apparatus which has the following combination of desirable features: (1) conveniently stores a number of forms of tobacco; (2) includes air-tight containers; (3) retains matches near the tobacco so that the tobacco can be readily lit; (4) provides with an ash receptacle for receiving the tobacco ashes; (5) includes support structures for supporting a burning cigar or cigarette; (6) includes a pipe rest that is adapted to prevent a pipe from tipping over when the pipe is placed in the pipe rest; (7) provides a rough surface that is suitable for igniting nonsafety matches; and (8) includes a plurality of air-tight containers that are prevented from moving around and bumping into each other. The foregoing desired characteristics are provided by the unique smoker's utility apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved smoker's utility apparatus which includes a base assembly which has a longitudinal axis and a transverse axis. A plurality of wells are contained within the base assembly. The wells include first wells adapted to receive containers. The wells include second wells adapted to receive pipe tools, and the wells include a third well extending substantially an entire longitudinal dimension of the base assembly adapted to receive a plurality of loose items. A plurality of containers are adapted to be received into the first wells in the base assembly. A plurality of pipe tools are adapted to be received into the second wells in the base assembly. A rough-surfaced striking surface is supported by the base assembly for igniting nonsafety matches struck on the rough-surfaced striking surface.

One of the containers received in the wells of the base assembly is an ash tray. The ash tray includes receiving areas adapted to receive a cigar or a cigarette. The ash tray includes a clamp assembly adapted to receive and support a pipe. The pipe clamp assembly is supported by a support column which is supported by a floor portion of the ash tray. The containers include air-tight containers. The air-tight containers include body portions and lid portions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a :new and improved smoker's utility apparatus which has all of the advantages of the prior art and none of the disadvantages.

It is another object of the present invention to provide a new and improved smoker's utility apparatus which may be easily and efficiently manufactured and marketed.

It is a further object of the present invention to provide a new and improved smoker's utility apparatus which is of durable and reliable construction.

An even further object of the present invention is to provide a new and improved smoker's utility apparatus which is susceptible of a low cost of manufacture with regard to both materials and labor, and which accordingly is then susceptible of low prices of sale to the consuming public, thereby making such smoker's utility apparatus available to the buying public.

Still yet a further object of the present invention is to provide a new and improved smoker's utility apparatus which conveniently stores a number of forms of tobacco.

Still another object of the present invention is to provide a new and improved smoker's utility apparatus that includes air-tight containers.

Yet another object of the present invention is to provide a new and improved smoker's utility apparatus which retains matches near the tobacco so that the tobacco can be readily lit.

Even another object of the present invention is to provide a new and improved smoker's utility apparatus that provides with an ash receptacle for receiving the tobacco ashes.

Still a further object of the present invention is to provide a new and improved smoker's utility apparatus which includes support structures for supporting a burning cigar or cigarette.

Yet another object of the present invention is to provide a new and improved smoker's utility apparatus that includes a pipe rest that is adapted to prevent a pipe from tipping over when the pipe is placed in the pipe rest.

Still another object of the present invention is to provide a new and improved smoker's utility apparatus which provides a rough surface that is suitable for igniting nonsafety matches.

Yet another object of the present invention is to provide a new and improved smoker's utility apparatus that includes a plurality of air-tight containers that are prevented from moving around and bumping into each other.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved smoker's utility apparatus embodying the principles and concepts of the present invention will be described.

Figure 1:
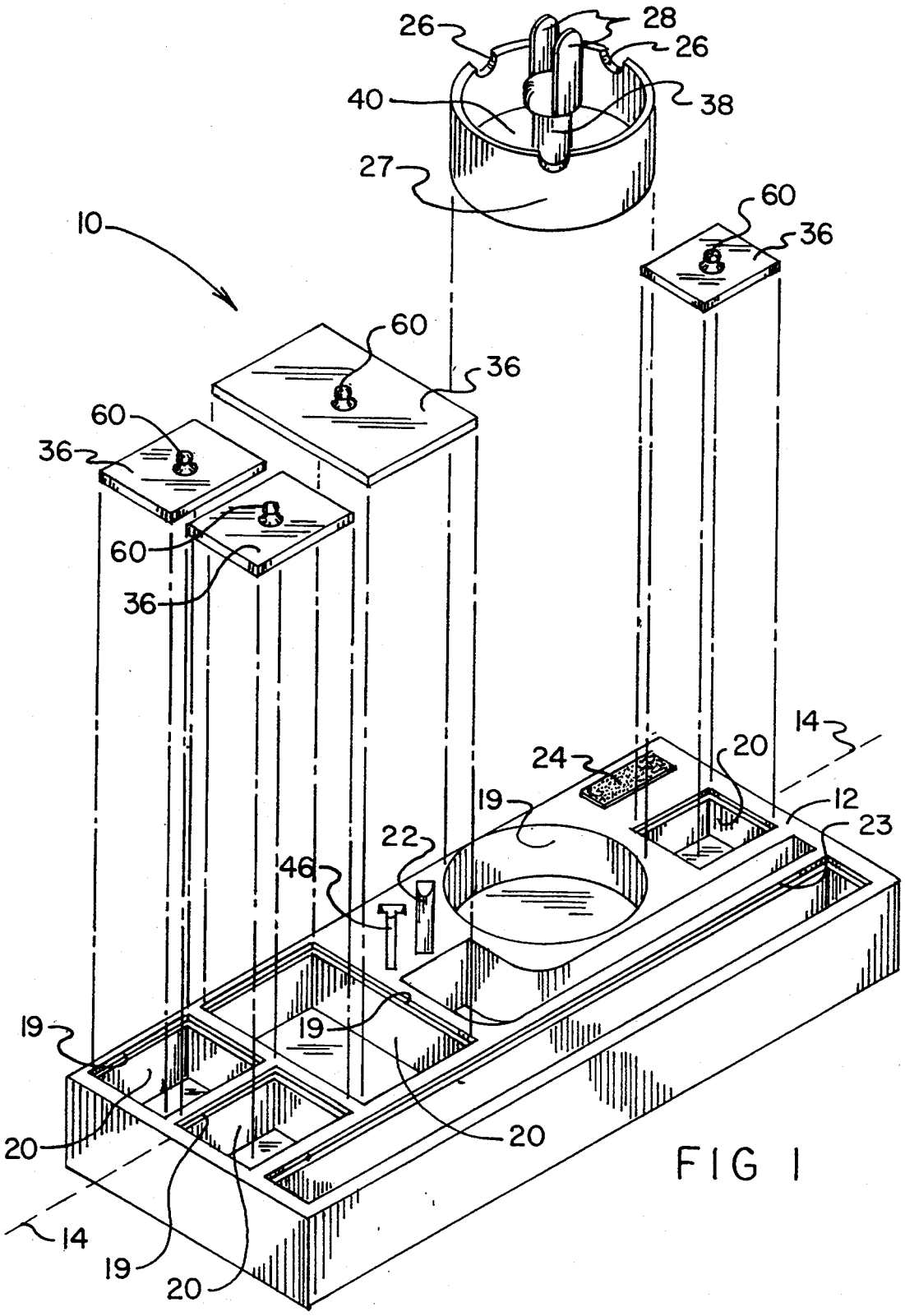
FIG. 1 is an exploded perspective view showing a preferred embodiment of the smoker's utility apparatus of the invention.
Figure 2:
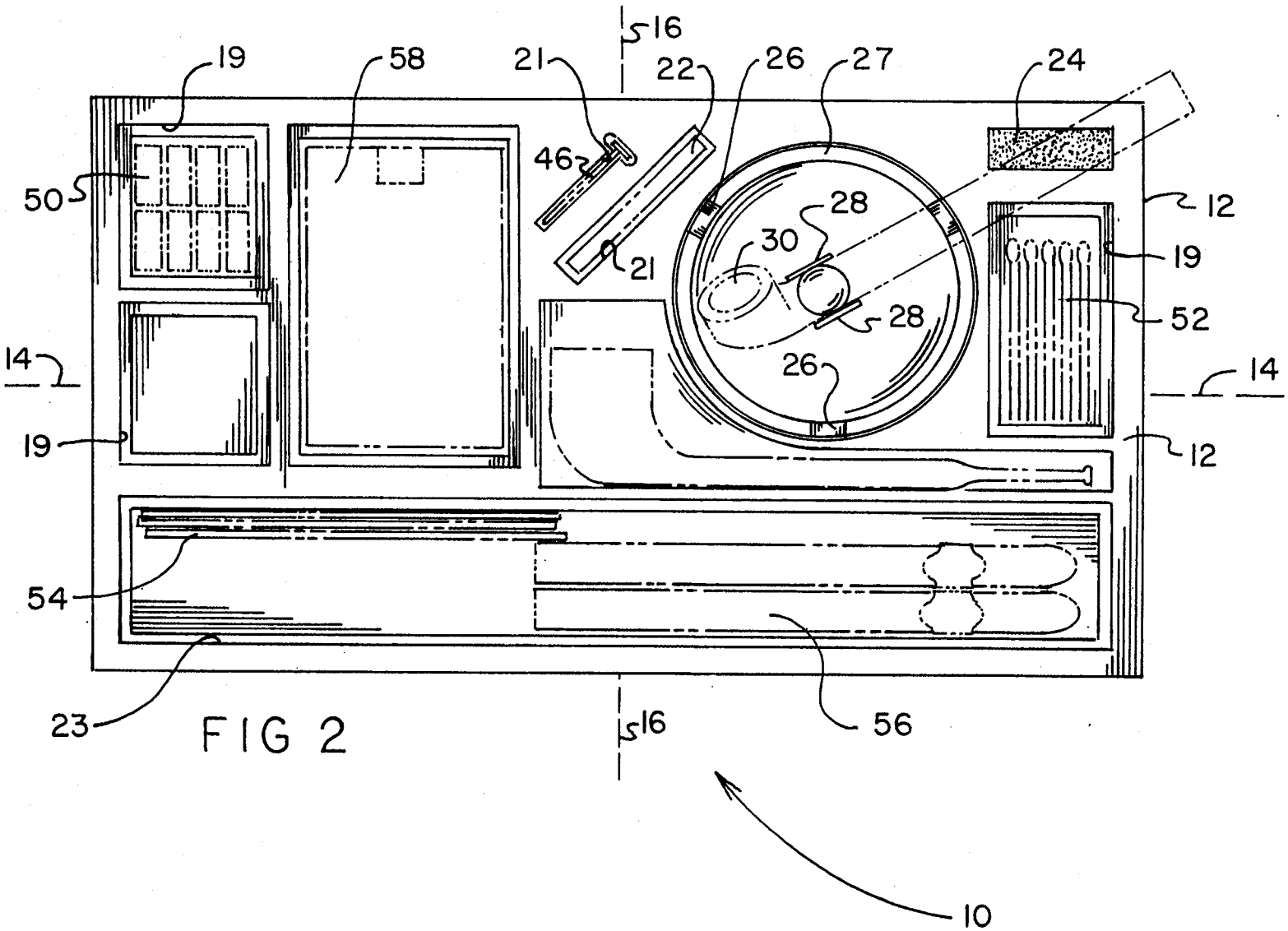
FIG. 2 is a top view of the embodiment of the smoker's utility apparatus shown in FIG. 1 taken with container covers removed.

Turning to FIGS. 1–2, there is shown an exemplary embodiment of the smoker's utility apparatus of the invention generally designated by reference numeral 10. In its preferred form, smoker's utility apparatus 10 includes a base assembly 12 which has a longitudinal axis 14 and a transverse axis 16. A plurality of wells are contained within the base assembly 12. The wells include first wells 19 adapted to receive containers 20. The wells include second wells 21 adapted to receive pipe tools 22, and the wells include a third well 23 extending substantially an entire longitudinal dimension of the base assembly 12 adapted to receive a plurality of loose items. A plurality of containers 20 are adapted to be received into the first wells 19 in the base assembly 12. A plurality of pipe tools 22 are adapted to be received into the second wells 21 in the base assembly 12. A rough-surfaced striking surface 24 is supported by the base assembly 12 for :igniting nonsafety matches 52 struck on the rough-surfaced striking surface 24.

One of the containers 20 received in the wells of the base assembly 12 is an ash tray 27. The ash tray 27 includes receiving areas 26 adapted to receive a cigar or a cigarette. The ash tray 27 includes a clamp assembly 28 adapted to receive and support a pipe 30. The pipe clamp assembly 28 damps onto the pipe stem near the base of the pipe bowl. The pipe clamp assembly 28 can have a snap action on the pipe 30. The pipe clamp assembly 28 is supported by a support column 38 which is supported by a floor portion 40 of the ash tray 27. The containers 20 include air-tight containers. The air-tight containers 20 include body portions and lid portions 36.

In use, the smoker's utility apparatus of the invention can be employed in a room in a building or in a motor vehicle. When employed in a room, the apparatus of the invention may include a layer of soft material attached to the bottom of the base assembly 12 to protect furniture surfaces upon which the apparatus of the invention may be placed. When employed in a motor vehicle, a quantity of adhesive material may be placed on the bottom of the base assembly 12 to permit the base assembly 12 to be adhered to a portion of the motor vehicle, such as the dashboard.

As shown in the drawing figures, a pipe nail 46 may be stored as well as another pipe tool 22. Pipe filters 50 may be stored in one container 20, and matches 52 may be stored in another container 20. Pipe cleaners 54 and cigars 56 may be stored in the longitudinally extending third well 23. A pack 58 of cigarettes is stored in yet another container 20. The lids 36 of the containers 20 include handles 60. In the air-tight containers 20, the lid portions 36 form an air-tight seal with the body portions of the containers. The air-tight containers 20 are especially useful for storing tobacco, such as pipe tobacco.

The components of the smoker's utility apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved smoker's utility apparatus that is low in cost, relatively simple in design and operation, and which may advantageously be used to conveniently store a number of forms of tobacco. With the invention, a smoker's utility apparatus is provided which includes air-tight containers. With the invention, a smoker's utility apparatus is provided which retains matches near the tobacco so that the tobacco can be readily lit. With the invention, a smoker's utility apparatus is provided which provides with an ash receptacle for receiving the tobacco ashes. With the invention, a smoker's utility apparatus is provided which includes support structures for supporting a burning cigar or cigarette. With the invention, a smoker's utility apparatus is provided which includes a pipe rest that is adapted to prevent a pipe from tipping over when the pipe is placed in the pipe rest. With the invention, a smoker's utility apparatus is provided which provides a rough surface that is suitable for igniting nonsafety matches. With the invention, a smoker's utility apparatus is provided which includes a plurality of air-tight containers that are prevented from moving around and bumping into each other.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved smoker's utility apparatus, comprising:

a base assembly which has longitudinal axis and a transverse axis, a plurality of wells contained within said base assembly, wherein said wells include first wells adapted to receive Containers, wherein said wells include second wells adapted to receive pipe tools, and wherein said wells include a third well extending substantially an entire longitudinal dimension of said base assembly adapted to receive a plurality of loose items, a plurality of containers adapted to be received into said first wells in said base assembly, a plurality of pipe tools adapted to be received into said second wells in said base assembly, and a rough-surfaced striking surface, supported by said base assembly, for igniting nonsafety matches struck on said rough-surfaced striking surface, wherein said containers include air-tight containers.

2. The apparatus described in claim 1 wherein said air-fight containers include body portions and lid portions.

* * * * *